US010004305B2

(12) United States Patent
McHugh

(10) Patent No.: US 10,004,305 B2
(45) Date of Patent: Jun. 26, 2018

(54) FLEXIBLE FOOT-LEG-THIGH-HIP JEWELERY

(71) Applicant: Elizabeth McHugh, Guttenberg, NJ (US)

(72) Inventor: Elizabeth McHugh, Guttenberg, NJ (US)

( * ) Notice: Subject to any disclaimer, the term of this patent is extended or adjusted under 35 U.S.C. 154(b) by 0 days. days.

(21) Appl. No.: 15/276,924

(22) Filed: Sep. 27, 2016

(65) Prior Publication Data

US 2018/0084874 A1 Mar. 29, 2018

(51) Int. Cl.
*A44C 15/00* (2006.01)
*A44C 25/00* (2006.01)
*A44C 17/00* (2006.01)

(52) U.S. Cl.
CPC ..... *A44C 15/009* (2013.01); *A44C 15/003* (2013.01); *A44C 17/00* (2013.01); *A44C 25/00* (2013.01); *A44C 25/007* (2013.01)

(58) Field of Classification Search
CPC . A61F 5/042; A44C 15/0045; A44C 15/0085; A44C 15/009; A44C 15/00; A44C 25/00; A41D 2400/38; A61H 2201/16
USPC ..... 2/244, 245, 336, 338
See application file for complete search history.

(56) References Cited

U.S. PATENT DOCUMENTS 1,584,476 A * 5/1926 Schalow ..... A41F 11/16 2/300
2,102,561 A * 12/1937 Loeber ..... A41F 11/16 2/309
5,535,448 A * 7/1996 Williamson ..... A41D 27/08 2/1
5,644,935 A * 7/1997 Jonovich ..... A44C 15/0085 63/3.2
D512,207 S * 12/2005 Choi ..... D2/946
D518,947 S * 4/2006 Choi ..... D2/976
D642,792 S * 8/2011 Tremblay ..... D3/218
2010/0199521 A1* 8/2010 Katz ..... A43B 1/0027 36/100
2012/0167278 A1* 7/2012 House ..... A61F 5/01 2/244
2014/0207042 A1* 7/2014 Amanatullah ..... A61F 5/0111 602/28

FOREIGN PATENT DOCUMENTS

CN 203226933 U * 10/2013

OTHER PUBLICATIONS

English machine translation of Weibing.*

* cited by examiner

*Primary Examiner* — Emily M Morgan

(57) ABSTRACT

The present invention is an innovative way to blend the barefoot sandal with the high tight stoking and garter belts, incorporating and assembling these with intricate artistic jewellery rudiments from the toes up to the legs and then up to the hips, enhancing the beauty of the foot up to leg and hip, as well as making it utile for temporarily holding small valuables, like cell phones, credit card or lipstick. The foot-leg-thigh-hip jewellery or barefoot sandal assembly system, wherein the style can be altered depending upon the occasion and can be worn only about the ankle or up to the knee or up to the thighs alone with the garter belt, providing a cost effective foot assembly accessory.

5 Claims, 6 Drawing Sheets

FLEXIBLE FOOT-LEG-THIGH-HIP JEWELERY

TECHNICAL FIELD OF THE INVENTION

This invention generally relates to the field of fashion, and particularly to an accessory for enhancing the beauty of one's foot and, more particularly, to a foot-leg-thigh-hip jewelry having interchangeable features like a barefoot sandals assembly, which is to be positioned at one's foot, more particularly, the leg, the thigh the hip or in any of the combinations stated for enhancing the beauty of one's foot vis-a-vis the wearer's clothing.

BACKGROUND OF THE INVENTION

Barefoot sandals are somewhat of a product of evolution from South Asia. These were first developed as variation of jewellery that was designed specifically for the feet and worn as a symbol of ceremonial celebration, especially for brides for celebrating their upcoming nuptials and vows. There are many variations of barefoot sandals which can be accomplished by altering the materials used or varying the styles used as well as varied utilization of the area of the foot or leg they cover. However, these all have one thing in common in that, they don't have soles like other sandals or shoes, and these usually have a loop in which to slide the second or third toe through and a tie or clasp that wraps around the ankle to hold them into place. These are meant more for decoration than practicality or protection for the feet. Conveniently, the beauty of barefoot sandals is that they can be worn by themselves or actually with traditional sandals that are open faced and do not cover or interrupt the sandal.

Besides, the mentioned barefoot sandals, another item worth mentioning to understand the present invention had its reference drawn from Garters, popular in the 1930s and 1940s, that apart from being a fancy wearable item doubled as a small purse to carry small valuables for ladies.

These garter belts or suspenders consist of an elasticised material strip of at least 2" to 3" in width, but could be wider, that is worn around the waist, to which 2 or 3 elastic suspender 'slings' are attached on each side, where the material is shaped to the contours of the body. The suspenders were typically clipped to the stockings with metal clips into which a rubber disc was inserted through the stocking material effectively 'locking' the stocking in place. These were normally attached to a length of elastic allowing for adjustment. These clips, also known as suspender slings, were best attached to stockings with a simple welt that do not have lace, or 'hold-ups' with a silicon rubber lining.

By way of example, U.S. Pat. No. 5,386,710 to Alberta M-Moore, discloses a foot jewellery; U.S. publication no. 2007/0062217 A1 discloses an instep jewellery, U.S. Pat. No. 4,502,158 to Mouri, Uemura and Koryo-cho discloses a slip down-free socks with a garter and lastly, U.S. Pat. No. Des. 335,102 to Crowder and Worchester discloses a leg ring.

While these devices fulfill their respective, particular objectives and requirements, the aforementioned patents do not describe a leg ornamentation device which enhances the aesthetic beauty of the leg of the wearer apart from providing functional utility of handy storage and having the flexibility of being worn in parts depending upon the occasion to be worn.

SUMMARY OF THE INVENTION

The present invention is an innovative way to blend the bare foot sandal with the high thigh stocking and garter belts, incorporating these with intricate artistic jewellery rudiments from the toes up to the legs and then up to the hips.

An objective of the present invention is to provide a foot-leg-thigh-hip jewelry assembly for enhancing the beauty of the foot up the leg, thigh and hip.

Another objective of the present invention, is to provide a scope for temporarily holding small valuables, like cell phones, or lipstick in place of a small purse.

Still another objective of the present invention is to provide a foot-leg-thigh-hip jewelry assembly, wherein the style can be altered depending upon the occasion and can be worn up to the ankle or up to the knee or up to the thighs alone, with the garter belt inserted for decoration only.

A further object of the present invention is to provide flexibility in fastening of the said decorative jewellery depending upon the design and the occasion of its wearing.

A still further objective of the present invention is to provide flexibility in the choice of materials, wherein, the materials could be any fabric, yarns, threads, elastics and fasteners which are elastically expandable and contractible.

Another objective of the present invention is to provide flexibility in weaving the foot-leg-thigh-hip jewelry, wherein, the technique involved could be either hand-made or machine made.

It is still yet another object of the invention to provide foot accessory, which can be a cost-effective means to access a particular outfit while enhancing the beauty of one's foot.

In addition to the various objects and advantages of the invention which have been described in some specific detail above it should be noted that various other objects and advantages of the present invention will become more readily apparent to those persons who are skilled in the relevant art from the following more detailed description, particularly, when such description is taken in conjunction with the attached drawing Figures and with the appended claims.

BRIEF DESCRIPTION OF THE DRAWINGS

The present invention will be described in more detail hereinafter with the aid of the description which relates to preferred embodiments of the invention explained with reference to the accompanying schematic drawings, in which.

DETAILED DESCRIPTION OF THE PREFERRED EMBODIMENTS

Figure 1:
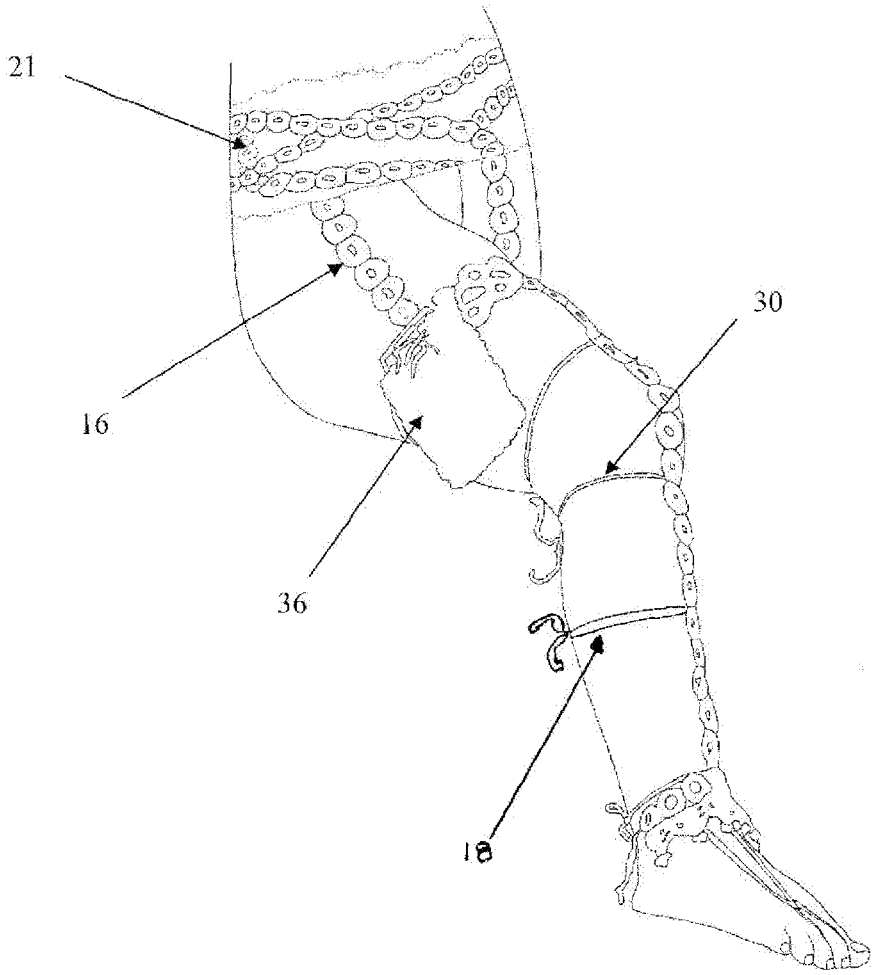
FIG. 1. illustrates the detailed view of the flexible jewelry assembly, with the provision of a pouch on the thigh of the decorative foot-leg-thigh-hip jewelry of the present invention.
Figure 2:
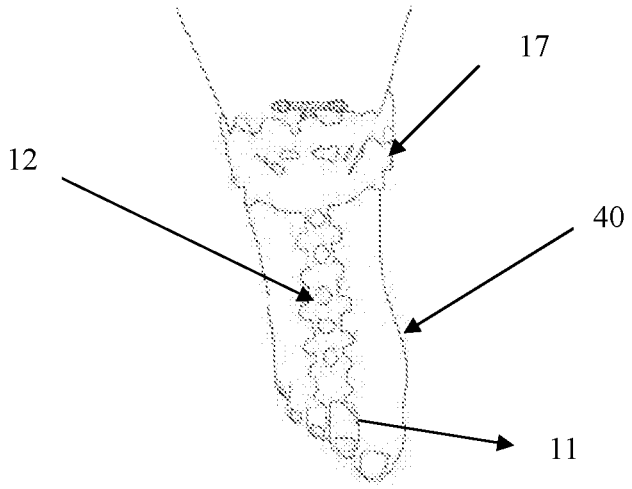
FIG. 2 illustrates the detailed front view of the foot part of the decorative foot-leg-thigh-hip jewelry assembly of the present invention.
Figure 2A:
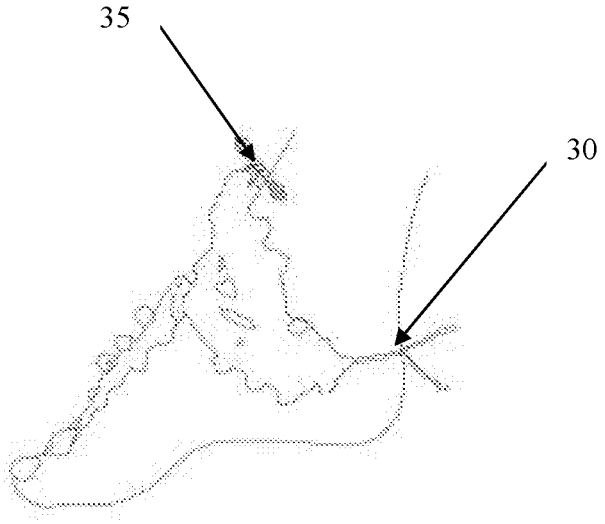
FIG. 2A illustrates the detailed side view of the foot part of the decorative foot-leg-thigh-hip jewelry assembly of the present invention.
Figure 3:
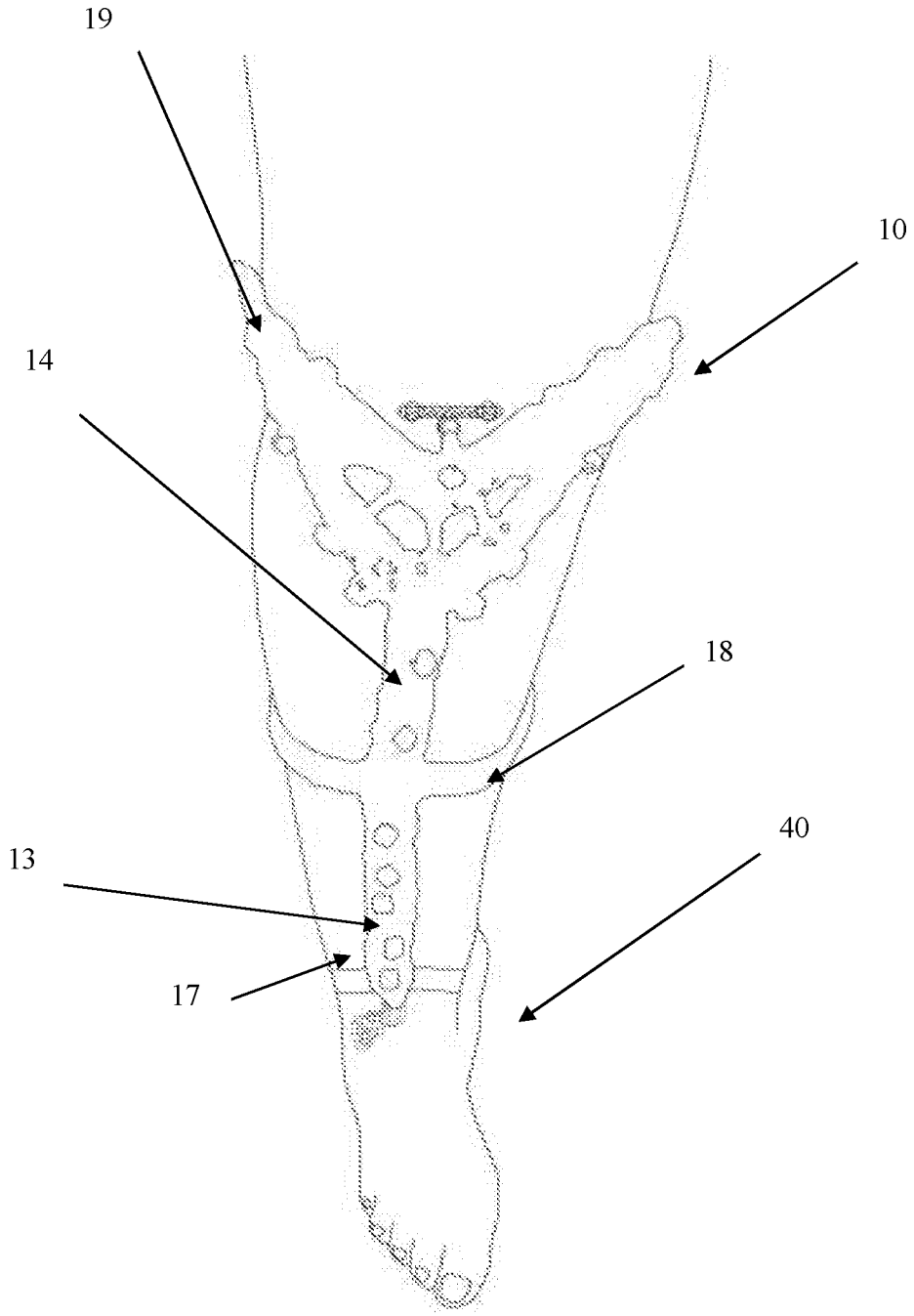
FIG. 3 illustrates the front view of the leg portion (the ankle, calf and knee part) of the decorative foot-leg-thigh-hip jewelry assembly of the present invention.
Figure 4:
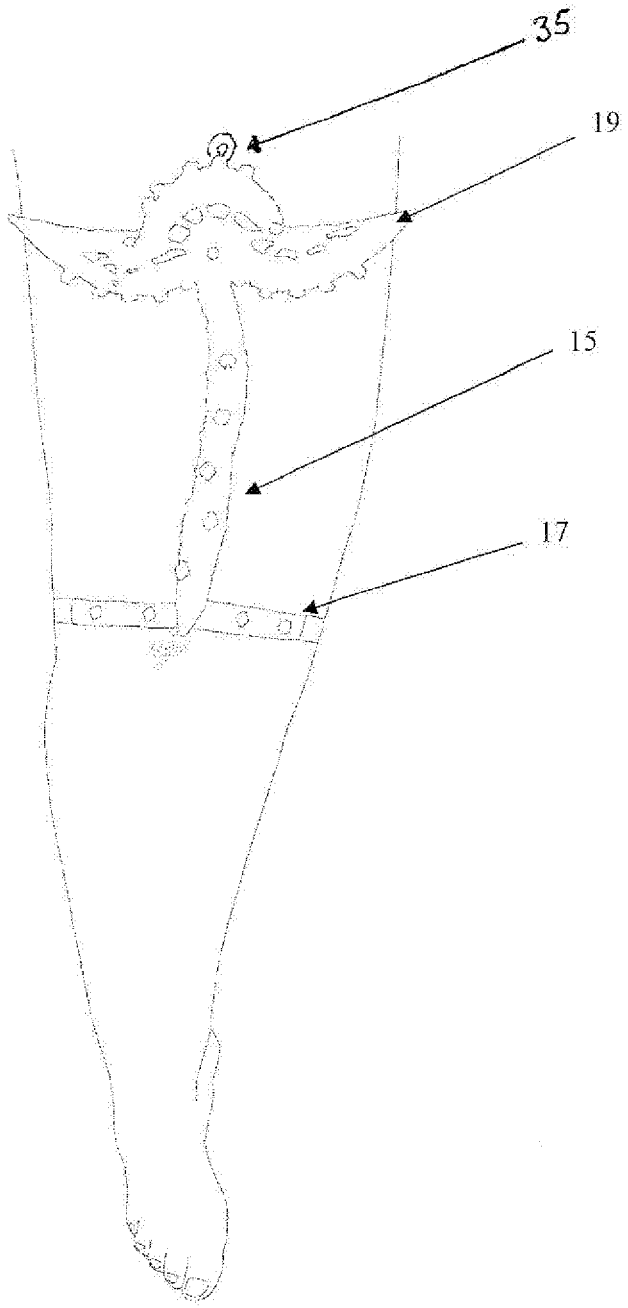
FIG. 4 illustrates the front view of the thigh portion (the knee part and thigh portion) of the decorative foot-leg-thigh-hip jewelry assembly of the present invention.
Figure 5:
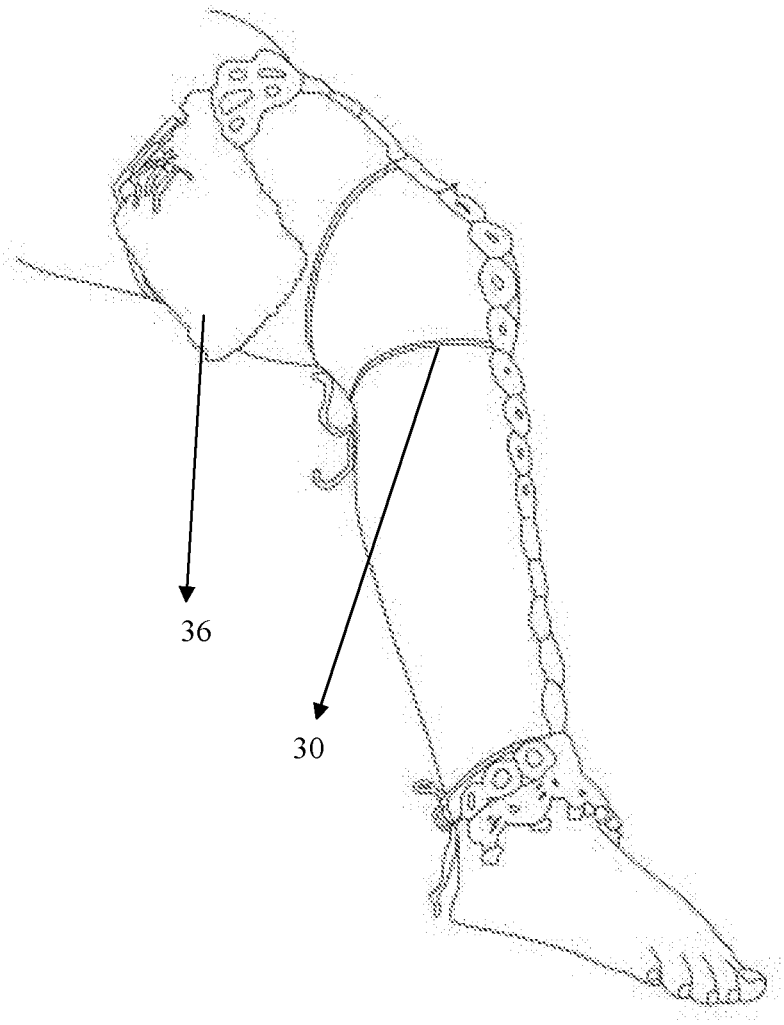
FIG. 5 illustrates the side view of the flexible jewelry (particularly the Foot-leg-and thigh portion) with provision of a pouch on the thigh of the decorative foot-leg-thigh-hip jewelry assembly of the present invention.
Figure 6:
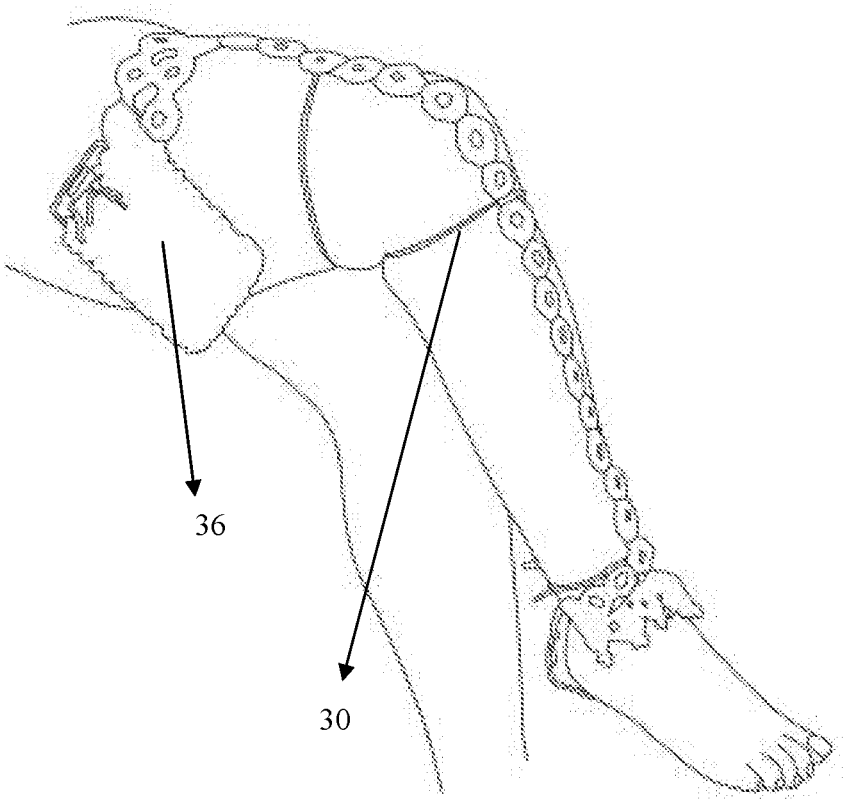
FIG. 6 illustrates another side view of the flexible jewelry assembly (particularly the foot-leg-and thigh portion) with provision of a pouch on the thigh of the decorative foot-leg-thigh-hip jewelry of the present invention.

Before describing the invention in detail, the reader is advised that, for the sake of clarity and understanding, identical components having identical functions have been marked where possible with the same reference numerals in each of the Figures provided in this document.

Now reference is made to the figures that show decorative foot-leg-thigh-hip jewelry, generally indicated as (10), to be worn on one's foot or leg or hip accordingly (40). This jewelry assembly comprises a plurality of straps made of flexible material. The foot-leg-thigh-hip jewelry assembly, initiates with predetermined foot strap (12), having a closed toe loop (11) which extends up the front of the foot, where it joins a predetermined decorative strap design (19) ending at the front/center of the ankle with connecting means (35) to the leg strap. This predetermined decorative strap design (19) wraps around the back of the wearer's ankle and fastened with cords (30).

The foot-leg-thigh-hip jewelry assembly starts with a leg strap (13) that has left and right cords (30) used for tying to the connecting means (35), the leg strap (13) extends up to the middle of the leg, where a predetermined horizontal calf strap (18) fastens around the calf with cords (30).

The foot-leg-thigh-hip jewellery assembly continues the leg strap to the knee where it joins a predetermined decorative strap design (19) ending at the front/center of the knee with connecting means (35) that ties to the thigh strap (15).

The foot-leg-thigh-hip jewellery assembly starts with a thigh strap (15) that has left and right cords (30) that ties to the connecting means (35) of the leg strap (13). The thigh strap extends above the knee where a horizontal thigh strap (20) fastens around the lower part of the thigh with left and right cords. The said thigh strap continues to the upper part of the thigh, where it joins a predetermined decorative strap design (19), ending at the front/center of the thigh with a connecting means (35), that fastens to a hip strap (16). The decorative strap design (19) loops around to the back of the wearer's thigh, where it is held with elastic means (38) that is connected to the pouch (36).

The foot-leg-thigh-hip jewellery assembly starts with a hip strap (16) that has left and right cords, which tie to the fastening means of the thigh (35), and connects to a horizomtal hip strap (21) that loops around to the back of the wearer's hip.

In an embodiment of the present invention, the hip strap on the hip region of the wearer is provided with fastening means, which can be hooks and eyes, snaps, eyelets, clips, cords, buttons, buckles and clasps.

The foot-leg-thigh-hip jewelry assembly of the present invention, comprises a plurality of straps consisting of predetermined widths, lengths, and designs (12), (13), (15), (16), (17), (18), (19), (21). The decorative strap designs in multiple shapes that look like angel wings, butterfly wings and crochet rings (19) of various sizes. Plurality of decorative means are provided to enhance the aesthetic beauty of the jewelry assembly.

In an embodiment of the present invention, the predetermined strap of the thigh portion of the foot-leg-thigh-hip jewelry is provided with an elastic band and or silicone band to help secure the jewelry snugly around the thigh, preventing it from sliding down the leg.

In another embodiment of the present invention, the decorative strap design (19) at the thigh portion of the wearer is further provided with a pouch (36) for holding small valuables, like cell phones, or lipstick thereby, providing an alternative to carrying a small purse In an embodiment of the present invention, the foot-leg-thigh-hip jewelry assembly can either be worn in a combined way or it can also be worn in parts, separately. To achieve the present result, each of the said decorative strap design at its upper portion is provided with a decorative eyelet woven with the fabric or yarn, which functions as an insertion point for the next strap to be worn.

In another embodiment of the present invention, the eyelet can further function to hold a decorative connecting means (35) for connecting the subsequent strap of the jewelry assembly with the preceding decorative strap design.

The materials used to make the foot-leg-thigh-hip jewelry assembly, of the present invention, could be any material, fabric, yarns and threads which can be elastically expandable and contractible, thereby providing flexibility of size to the wearer.

The foot-leg-thigh-hip jewelry assembly of the present invention could be handmade with techniques like sewing, crochet and weaving or can be machine made.

The foot-leg-thigh-hip jewelry assembly of the present invention are further provided with decorative means, for enhancing the aesthetic beauty of the said jewelry. This decorative means can be one or a plurality of charms, precious stones, semi-precious stones, non-precious stones, beads and/or bows or any other well known decorative member that can be threaded onto the plurality of straps.

The foregoing descriptions of specific embodiments of the present invention have been presented for purposes of illustration and description only. They are not intended to be exhaustive or to limit the present invention to the precise forms disclosed, and obviously modifications remain possible, in particular from the point of view of the design of the various elements or by substitution of equivalent methods, without thus departing from the scope of protection of the invention.

What is claimed is:

1. A jewelry kit for decorating a leg of a wearer, the kit comprising:

a foot segment having a toe loop and a first cord, the toe loop and first cord are connected by a first bridge configured to be worn on the top of a foot of the wearer, the first cord is configured to be tied around an ankle of the wearer, the first bridge having a first connector; and a calf segment having a second bridge configured to be adjacent to the first bridge and connected via the first connector, the calf segment also having a plurality of second cords configured to be tied around a calf of a wearer, and a third bridge with a second connector; and a thigh segment having a fourth bridge configured to be adjacent to the third bridge and connected via the second connector, the thigh segment comprising a plurality of third cords configured to be tied around a thigh of the wearer; and a hip segment having a fifth bridge configured to be adjacent and connectable to the thigh segment, the hip segment having a band configured to be worn around a waist of the wearer, and;

wherein each segment is capable of being worn separately, or in combination with an adjacent segment.

2. The jewelry kit of claim 1, wherein the band of the hip segment is provided with fastening means selected from the group consisting of: hooks and eyes, snaps, eyelets, clips, cords, buttons, buckles, and clasps.

3. The jewelry kit of claim 1, wherein the bridges are made of a flexible material.

4. The jewelry kit of claim 1, further comprising a pocket connected to the thigh segment.

5. The jewelry kit of claim 1, further comprising one or more decorative articles selected from the group consisting of: charms, precious stones, semi-precious stones, non-precious stones, beads and bows.

* * * * *